US010301736B2

(12) United States Patent
Zhao et al.

(10) Patent No.: US 10,301,736 B2
(45) Date of Patent: May 28, 2019

(54) SINGLE-FACE ELECTROGALVANIZED, CHROMIUM-FREE SURFACE TREATED STEEL PLATE FOR FUEL TANK AND SURFACE TREATMENT AGENT

(71) Applicant: Baoshan Iron & Steel Co., Ltd., Shanghai (CN)

(72) Inventors: Yanliang Zhao, Shanghai (CN); Yigang Dai, Shanghai (CN); Jianping Zhang, Shanghai (CN); Lan Zhu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 715 days.

(21) Appl. No.: 14/763,887

(22) PCT Filed: Jan. 14, 2014

(86) PCT No.: PCT/CN2013/090489
§ 371 (c)(1),
(2) Date: Jul. 28, 2015

(87) PCT Pub. No.: WO2014/117609
PCT Pub. Date: Aug. 7, 2014

(65) Prior Publication Data

US 2015/0361572 A1 Dec. 17, 2015

(30) Foreign Application Priority Data

Jan. 31, 2013 (CN) ..... 2013 1 0036910

(51) Int. Cl.
*C25D 5/48* (2006.01)
*C23C 22/44* (2006.01)
(Continued)

(52) U.S. Cl.
CPC ..... *C25D 5/48* (2013.01); *B05D 1/28* (2013.01); *C23C 22/44* (2013.01); *C25D 7/0614* (2013.01);
(Continued)

(58) Field of Classification Search
CPC ..... C25D 5/48; C23C 22/44; C23C 22/34; C23C 22/80; C23C 22/83; B05D 1/28; B05D 3/002
(Continued)

(56) References Cited

U.S. PATENT DOCUMENTS 6,387,538 B1 * 5/2002 Lee ..... C23C 28/00 148/258
6,558,480 B1 * 5/2003 Rochfort ..... C23C 22/34 148/247
(Continued)

FOREIGN PATENT DOCUMENTS

CN 1277640 12/2000
CN 1530462 A 9/2004
(Continued)

OTHER PUBLICATIONS

English translation of the Written Opinion of the International Search Authority dated Apr. 22, 2014 for PCT/CN2013/090489; 16 pages.*
(Continued)

*Primary Examiner* — Helene Klemanski
(74) *Attorney, Agent, or Firm* — Quarles & Brady LLP

(57) ABSTRACT

The invention relates to an inorganic aqueous surface treatment agent for a single-face electrogalvanized, chromium free surface treated steel plate, a single-face electrogalvanized, chromium-free surface treated steel plate used for fuel tanks and a process of making the same. The inorganic
(Continued)

aqueous surface treatment agent for a single-face electrogalvanized, chromium free surface treated steel plate comprises the following components: one or more metallic ion compounds comprising at least one of $Zn^{2+}$, $Mn^{2+}$, $Mg^{2+}$, $Ni^{2+}$, $Al^{3+}$ and $Ca^{2+}$; one or more vanadium compounds comprising at least one of $V^{4+}$ and $V^{5+}$; one or more compounds comprising at least one of phosphoric acid, pyrophosphoric acid, metaphosphoric acid, organic phosphoric acid and the ammonium salts thereof; one or more fluoric acid compounds comprising at least one of Zr, Ti, Si and Ha; one or more silane coupling agents comprising at least one of vinyl silane coupling agent, amino silane coupling agent, epoxy silane coupling agent and acryloxy silane coupling agent; a silica sol having a particle diameter less than 100 nm; one or more surfactants comprising at least one of carboxylate, sulfuric acid ester salt, sulfonate and phosphoric acid ester salt; wherein the total solid content in the inorganic aqueous surface treatment agent is 2 wt %-20 wt % of the surface treatment agent. The process for preparing the single-face electrogalvanized chromium-free surface treated steel plate used for fuel tanks comprises the steps of coating the plated surface of the single-face electrogalvanized steel plate with the above surface treatment agent, solidifying at a temperature of 70-100° C., and finally oil finishing on the surface to produce a skin film resulting from the surface treatment with a weight of 100-600 mg/$m^2$.

12 Claims, 1 Drawing Sheet

(51) Int. Cl.

| | |
|---|---|
| ***C23C 22/34*** | (2006.01) |
| ***C23C 22/80*** | (2006.01) |
| ***C23C 22/83*** | (2006.01) |
| ***B05D 1/28*** | (2006.01) |
| ***B05D 3/00*** | (2006.01) |
| ***C25D 7/06*** | (2006.01) |

(52) U.S. Cl.
CPC ... *C23C 2222/20* (2013.01); *Y10T 428/12535* (2015.01)

(58) Field of Classification Search
USPC ..... 106/1.25, 1.29; 148/247
See application file for complete search history.

(56) References Cited

U.S. PATENT DOCUMENTS

| | | | | |
|---|---|---|---|---|
| 2005/0037208 | A1* | 2/2005 | Ogino | C23C 22/68 428/425.8 |
| 2008/0302448 | A1* | 12/2008 | Frey | C23C 22/83 148/274 |
| 2009/0032144 | A1* | 2/2009 | McMillen | C23C 22/44 148/247 |
| 2009/0252952 | A1* | 10/2009 | Noh | C23C 22/83 428/328 |
| 2010/0035055 | A1 | 2/2010 | Okai et al. | |
| 2010/0243465 | A1* | 9/2010 | Inbe | C23C 22/34 205/184 |
| 2011/0041957 | A1* | 2/2011 | Brouwer | C23C 22/34 148/247 |
| 2011/0094630 | A1* | 4/2011 | Yoshida | C23C 22/34 148/247 |
| 2013/0284049 | A1* | 10/2013 | Miura | C23C 22/34 106/14.45 |
| 2016/0068704 | A1* | 3/2016 | Ma | C09D 5/08 428/626 |

FOREIGN PATENT DOCUMENTS

| | | | |
|---|---|---|---|
| CN | 1814860 | A | 8/2006 |
| CN | 1887449 | A | 1/2007 |
| CN | 1887451 | A | 1/2007 |
| CN | 101346493 | | 1/2009 |
| CN | 101535529 | | 2/2012 |
| CN | 102400076 | | 4/2012 |
| CN | 103060788 | | 4/2013 |
| JP | 2010095746 | | 4/2010 |
| JP | 2012026033 | | 2/2012 |
| SG | 186231 | A1 * | 1/2013 |

OTHER PUBLICATIONS

English translation of CN 1887449, Jan. 2007; 18 pages.*
English translation of CN 1887451, Jan. 2007; 17 pages.*
Snowtex Datasheet; www.nissanchem-usa.com/products/snowtex/; no date available; 5 pages.*
International Search Report dated Apr. 22, 2014 for International Application No. PCT/CN2013/090489.
The State Intellectual Property Office of People's Republic of China, First Office Action and Search Report, Application No. 201310036910.0, dated Nov. 4, 2014.
Australian Government IP Australia, Examination Report No. 1, Application No. 2014211915, dated Jun. 27, 2017.
European Patent Office, Extended European Search Report, Application No. 13873622.8, dated Nov. 14, 2016.

* cited by examiner

SINGLE-FACE ELECTROGALVANIZED, CHROMIUM-FREE SURFACE TREATED STEEL PLATE FOR FUEL TANK AND SURFACE TREATMENT AGENT

CROSS-REFERENCE TO RELATED APPLICATIONS

This application represents the national stage entry of PCT International Application No. PCT/CN2013/090489 filed Jan. 14, 2014 and claims the benefit of Chinese Patent Application 201310036910.0 filed Jan. 31, 2013. The contents of both of these applications are hereby incorporated by reference as if set forth in their entirety herein.

TECHNICAL FIELD

The invention pertains to the field of surface treatment of metallic material, and relates to a single-face electrogalvanized, chromium-free surface treated steel plate used for a fuel tank and having superior gasoline degradation liquid resistance and good processability, a process of making the same, and a surface treatment agent for treating the single-face electrogalvanized, chromium-free surface treated steel plate.

BACKGROUND ART

Fuel tanks may be classified into motorcycle fuel tank, automobile fuel tank and general fuel tank according to their uses. Motorcycle fuel tank mainly employs steel tank, while automobile fuel tank generally uses plastic tank and steel tank. Because of the strong requirements of lightening and cost reduction of automobiles, plastic fuel tanks have been favored by automobile manufacturers for a time, which leads to loss of a considerable portion of the market for steel tanks. However, along with the sequential issues of environmental protection and safety regulations which are increasingly strict in the automobile industry, steel fuel tanks exhibit their advantages gradually. The main direction of development is pointed to materials for steel fuel tanks which are environmentally friendly, free of lead and chromium, easily processable and highly corrosion resistant. At present, the materials for steel fuel tanks used commercially are generally classified into three types, namely carbon steel, stainless steel and aluminum alloy, wherein coated products of cold rolled carbon steel plate are most widely used. There are many types of coated products of carbon steel, including those obtained by hot-dip galvanizing, hot-dip zinc-iron alloy coating, hot-dip aluminizing, hot-dip lead coating, hot-dip tin-zinc coating, zinc-nickel electroplating, zinc electroplating, etc. Nippon Steel Co., JFE, POSCO, etc, have set foot in the above products.

Nippon Steel Co. replaces the traditional lead-tin coated steel plate with a steel plate material having hot-dip tin-zinc coating for automobile fuel tanks. Although corrosion resistance and high permeation resistance are achieved, it is a steel plate with hot-dip tin-zinc coating.

Electrogalvanized and surface treated steel plates for fuel tanks are available from JFE under the names of GT and GP, wherein single-face zinc-nickel electroplating plus single-face special treatment are conducted for GT which is used for corrosion-resistant fuel tanks, while double-face electrogalvanizing plus double-face special treatment are conducted for GP which is used for highly corrosion-resistant fuel tanks.

Chinese patent application CN1277640A discloses a surface treated steel plate used for oil tanks and a process of making the same. The surface treated steel plate is obtained by a double coating/double baking process resulting in a chromate skin film and a resin coating on a zinc or zinc family alloy coating, wherein the chromate layer is formed by using trivalent chromium, phosphoric acid, fluoric acid, sulfuric acid, colloidal silica and an epoxy silane coupling agent as primary film forming agents, and baking at a metal temperature in the range of 120-250° C. for solidification; and the resin coating is formed by using a resin solution comprising the essential components of phenoxy resin, colloidal silica and melamine resin, and baking at a metal temperature in the range of 160-250° C. for solidification. This surface treated steel plate exhibits good corrosion resistance, chemical resistance, fuel resistance and coating adhesion. However, the double coating/double baking process is rather complex and expensive, and the surface treatment with chromate cannot meet the requirement of environmental protection that a chromium free material should be used.

Chinese patent application CN101346493A discloses a surface treated, chromium free steel plate used for oil tanks and a process of making the same. The surface treated steel plate is obtained by a double coating/double baking process resulting in a chromium free skin film and a resin coating on a zinc-based electroplated steel plate, wherein the chromium free layer is formed by using silicate, a silane coupling agent, a titanium compound, an binder resin and a phosphoric acid ester as primary film forming agents, and baking at a metal temperature in the range of 120-250° C. for solidification; and the resin coating is formed by using a solution comprising the essential components of phenoxy resin, melamine resin, silica, silicon dioxide, metal powder and a phosphoric acid ester, and baking at a metal temperature in the range of 190-250° C. for solidification. Although the requirement of environmental protection with respect to the material used for fuel tanks is taken into account in this invention, similar to Chinese patent application CN1277640A, a double coating/double baking process is used in the manufacture, and an even higher solidification temperature is used. Hence, there exist problems including process complexity, high demand on production equipments, high energy consumption, etc., which lead to high manufacture cost.

Chinese patent application CN102400076A discloses a hot-dip tin-zinc alloy coated steel plate for fuel tanks and a method of making the same. It is a zinc-tin coated product, and used for processing fuel tanks without surface treatment of the coating.

SUMMARY

The object of the invention is to provide a single-face electrogalvanized, chromium free surface treated steel plate used for fuel tanks and having superior gasoline degradation liquid resistance and good processability, a process of making the same, and a surface treatment agent for treating the electrogalvanized, chromium free surface treated steel plate, so as to overcome the shortcomings or deficiencies existing in the prior art.

In order to achieve the above object, the invention employs the following technical solution:

According to the invention, firstly there is provided an inorganic aqueous surface treatment agent for the single-face electrogalvanized, chromium free surface treated steel plate having superior gasoline degradation liquid resistance, good salt fog corrosion resistance and good processability. This surface treatment agent enables steady production of the above single-face electrogalvanized, chromium free surface treated steel plate.

An inorganic aqueous surface treatment agent for a single-face electrogalvanized, chromium free surface treated steel plate is formulated by dissolving or dispersing various compositions in an aqueous medium, wherein the resulting aqueous solution comprises the following components:

(A) one or more metallic ion compounds comprising at least one of $Zn^{2+}$, $Mn^{2+}$, $Mg^{2+}$, $Ni^{2+}$, $Al^{3+}$ and $Ca^{2+}$, wherein the molar concentration of the metallic ion in the surface treatment agent is 0.01-0.3 mol/L;

(B) one or more vanadium compounds comprising at least one of a compound containing $V^{4+}$ and a compound containing $V^{5+}$, wherein the molar concentration of V element in the surface treatment agent is 0.005-0.08 mol/L;

(C) one or more compounds comprising at least one of phosphoric acid, pyrophosphoric acid, metaphosphoric acid, organic phosphoric acid and their ammonium salts, wherein the molar concentration of P element in the surface treatment agent is 0.05-1 mol/L;

(D) one or more fluoric acid compounds comprising at least one of Zr, Ti, Si and Ha, wherein the fluoric acid compound comprises 6 fluorine atoms, and the molar concentration of F element in the surface treatment agent is 0.01-0.2 mol/L;

(E) one or more silane coupling agents comprising at least one of vinyl silane coupling agent, amino silane coupling agent, epoxy silane coupling agent and acryloxy silane coupling agent, wherein the molar concentration of the silane coupling agent in the surface treatment agent is 0.1-0.5 mol/L;

(F) a silica sol having a particle diameter less than 100 nm, wherein the molar concentration of Si element in the surface treatment agent is 0.01-0.2 mol/L;

(G) one or more surfactants comprising at least one of carboxylate salt, sulfuric acid ester salt, sulfonate salt and phosphoric acid ester salt, wherein the molar concentration of the surfactant in the surface treatment agent is 0.0001-0.003 mol/L;

wherein the total solid content in the inorganic aqueous surface treatment agent is 2 wt %-20 wt % of the surface treatment agent.

Preferably, when the total solid content is 4 wt %-15 wt % of the surface treatment agent, and more preferably 5 wt %-10 wt %, better coating performance and longer effective solution storage time can be achieved.

According to the invention, the metallic ion compound comprises at least one metallic ion selected from $Zn^{2+}$, $Mn^{2+}$, $Mg^{2+}$, $Ni^{2+}$, $Al^{3+}$ and $Ca^{2+}$ ions, and its molar concentration in the surface treatment agent solution is 0.01-0.3 mol/L, preferably 0.07-0.2 mol/L. The above metallic ion compound may be added into the solution system in the form of dihydrogen phosphate, hydrogen phosphate or phosphate of the metallic ion. This component is subjected to chemical reaction and forms a highly rigid fine reaction layer which is arranged densely in the coating structure. This layer principally acts to enhance corrosion resistance (mainly contribute to the resistance to the corrosion of acidic medium such as degradation liquid, etc.) and improve wear resistance and lubrication of the surface. If the metallic ion content is lower than 0.01 mol/L, the corrosion resistance to gasoline degradation liquid, wear resistance and lubrication performance of the resulting single-face electrogalvanized, chromium free surface treated steel plate material will be decreased too significantly to meet the requirement of the product. If the metallic ion content is higher than 0.3 mol/L, the adhesion of the surface coating will be affected.

The compounds selected from V(V) and/or V(IV) in the inventive surface treatment agent, i.e. compounds containing $V^{4+}$ and compounds containing $V^{5+}$, may be selected from vanadium pentoxide, vanadium tetroxide, sodium metavanadate, ammonium metavanadate, sodium pyrovanadate, vanadyl sulfate, vanadyl oxalate, etc. The V element content is 0.005-0.08 mol/L; preferably 0.005-0.03 mol/L. Vanadium is a multi-valent element, and is present in compounds in a valence of +5, +4, +3, +2, etc., wherein compounds having high valences of +5 and +4 show strong oxidation to zinc. This component acts to oxidize the surface of the galvanized layer via variation of chemical reaction valence in the course of film formation. The formation of an oxide film may improve the corrosion resistance of the material surface. When the addition amount is fixed, higher vanadium valence leads to more significant oxidation, but affects the compatibility and stability of the solution system remarkably. The compatibility and stability of high valence vanadium in the surface treatment agent can only be achieved by suitable system adjustment. Likewise, in a certain content range, larger addition amount of the oxidative vanadium compound will result in more obvious oxidation performance of the surface treatment agent, thus leading to increased corrosion resistance of the material surface. However, if the V element content in the system is higher than 0.08 mol/L, the stability of the surface treatment solution is decreased, and the homogeneity of the film formation is lowered in the process of coating. Hence, the V element content is desirably 0.005-0.08 mol/L.

In the surface treatment agent of the invention, among the compounds selected from phosphoric acid, pyrophosphoric acid, metaphosphoric acid, organic phosphoric acid and their ammonium salts, the organic phosphoric acid may be selected from nitrilotris(methylene phosphonic acid), 1-hydroxyethylidene-1,1-diphosphonic acid, sodium ethylenediamine tetramethylene phosphate, etc., and has a content of 0.05-1 mol/L, preferably 0.08-0.4 mol/L based on phosphorus element. According to the invention, phosphorus element is incorporated into the solution in the form of phosphoric acid or organic phosphoric acid, etc., to provide the surface treatment agent with a stable acidic environment having a pH in the range of 2-5, and undergoes chemical reaction with metallic cations such as zinc ions and the like at the interface during the film forming reaction to form a phosphate salt protective film, so as to improve the coating surface's resistance to salt fog corrosion and gasoline degradation liquid corrosion. As shown by the study according to the invention, if the phosphorus element content in the surface treatment agent is less than 0.05 mol/L, the salt fog resistance of the coating surface decreases remarkably and thus can not meet the requirement of the material for surface resistance. If the phosphorus element content is more than 1 mol/L, the stability of the surfactant solution system decreases.

In the surface treatment agent of the invention, the fluoric acid compound comprising at least one of Zr, Ti, Si and Ha should have 6 fluorine atoms, and is selected from e.g. ammonium hexafluorotitanate, ammonium hexafluorozirconate, etc. The fluorine element content in the solution system of the surface treatment agent is 0.01-0.2 mol/L, preferably 0.04-0.1 mol/L. During the film formation effected by the surface treatment agent, the surface of the zinc layer is homogenized rapidly due to the strong corrosion effect of the fluoric acid compound on the zinc surface, so that the homogeneity of the film formation is guaranteed in the course of coating. If the F element content is less than 0.1 mol/L, the film forming property of the surface treatment agent will get worse. If the F element content is more than 1.0 mol/L, the fluoric acid compound will influence the stability of the surface treatment agent system.

In the surface treatment agent of the invention, the silane coupling agent comprises at least one of vinyl silane coupling agent, amino silane coupling agent, epoxy silane coupling agent and acryloxy silane coupling agent and has a content of 0.1-0.5 mol/L, preferably 0.1-0.4 mol/L. One silane coupling agent may be used and added alone, or several silane coupling agents may be used in combination. During the film formation on the surface, the hydrophilic group in the silane coupling agent bonds to the metallic surface to form siloxane. The addition of a suitable silane coupling agent may improve effectively the salt fog resistance, alkali resistance and black tarnishing resistance of the coating. If the content of the silane coupling agent is less than 0.1 mol/L, the surface of the coated product will have apparently decreased resistance to alkali cleansing and salt fog corrosion. If the content is more than 0.5 mol/L, the relative content of the inorganic salt additive in the skin film resulting from the surface treatment will decrease significantly, and thus the product's resistance to the corrosion of the gasoline degradation liquid will be affected.

The surface treatment agent of the invention comprises a silica sol selected from at least one aqueous dispersion system which has weak acidity and has a particle diameter less than 100 nm, wherein the particle diameter is preferably less than 50 nm, and the content of the silica sol in the surface treatment agent is 0.01-0.2 mol/L, preferably 0.06-0.12 mol/L based on silicon element. Since silicon generally undergoes chemical reaction at a temperature of 300-600° C. which is much higher than the temperature at which the surface treatment agent forms a film (70-100° C.), the silicon element in the silicon oxide does not take part in the chemical reaction during film formation. In the silica sol system, a large quantity of silanol groups (Si—OH) on the surface of the silicon dioxide particles react with the Zn—OH group on the surface of the galvanized layer and adheres to the plated layer surface after dehydration. After solidification and film formation, a —Si—O—Si— network structure is formed. During the formation of this structure, the metallic ions in the solution system are distributed evenly, and the film forming property of the surface treatment agent on the surface as well as the corrosion resistance and wear resistance of the coating are further improved. As experimentally indicated, if the silicon element content in the surface treatment agent system is more than 1 mol/L, the stability of the solution system will be affected.

In the surface treatment agent of the invention, the surfactant is selected from at least one of carboxylate salt, sulfuric acid ester salt and sulfonate salt, and may be selected specifically from at least one of fluorinated carboxylic acid, sodium fatty alcohol polyoxyethylene ether carboxylate, ternary polycarboxylic acid, sodium dodecyl sulfate, sodium dodecyl sulfonate, etc. The content of the surfactant in the surface treatment agent is 0.0001-0.003 mol/L, preferably 0.0005-0.0015 mol/L. The surfactant mainly acts to improve the film forming property of the surface treatment agent. If its content is less than 0.0001 mol/L, inhomogeneous film formation on the surface will occur in continuous production wherein film is formed by roll coating. If the content is more than 0.003 mol/L, the excessive surfactant will affect the resistance of the coating surface, particularly the resistance to the corrosion of the gasoline degradation liquid.

The invention also provides a method of treating a single-face electrogalvanized, chromium free surface treated steel plate used for fuel tanks and having superior resistance to gasoline degradation liquid, good salt fog corrosion resistance and good processability.

A method of treating a single-face electrogalvanized, chromium free surface treated steel plate used for fuel tanks comprises: coating the plated layer surface of an electrogalvanized steel plate with the above inorganic aqueous surface treatment agent, and then solidifying at 70-100° C. to obtain a single-face electrogalvanized, chromium free surface treated steel plate having a skin film of 100-600 mg/m$^2$ resulting from the surface treatment.

The invention also provides a single-face electrogalvanized, chromium free surface treated steel plate which is Cr free, environmentally friendly, has superior resistance to gasoline degradation liquid, good salt fog corrosion resistance and good processability, and may be used for fuel tanks.

A single-face electrogalvanized, chromium free surface treated steel plate used for fuel tanks, has its single-face plated surface coated with a skin film resulting from surface treatment, wherein the skin film resulting from surface treatment comprises the following components:

a metallic ion compound comprising at least one of $Zn^{2+}$, $Mn^{2+}$, $Mg^{2+}$, $Ni^{2+}$, $Al^{3+}$ and $Ca^{2+}$ ions, wherein the metallic ion compound comprises 1%-10% by weight of the skin film resulting from surface treatment based on metallic elements;

a vanadium containing compound selected from at least one of compounds comprising $V^{4+}$ and compounds comprising $V^{5+}$, wherein the vanadium containing compound comprises 0.1%-5% by weight of the skin film resulting from surface treatment based on vanadium element;

a phosphorus containing compound, which comprises 1%-10% by weight of the skin film resulting from surface treatment based on phosphorus element;

a fluorine containing compound, which comprises 1%-10% by weight of the skin film resulting from surface treatment based on fluorine element;

a silicon containing compound, which comprises 1%-10% by weight of the skin film resulting from surface treatment based on silicon element;

a surfactant, which comprises 0.1%-1% by weight of the skin film resulting from surface treatment;

wherein the weight of the plated layer of the single-face electrogalvanized, chromium free surface treated steel plate is 10-110 g/m$^2$; wherein the above indicated inorganic skin film resulting from surface treatment and covering the plated layer surface is a monolayer structure, and has a film weight of 100-600 mg/m$^2$, preferably 250-450 mg/m$^2$.

Further, the vanadium containing compound is selected from at least one of compounds comprising $V^{4+}$ and compounds comprising $V^{5+}$; the phosphorus containing compound is selected from at least one of phosphoric acid, pyrophosphoric acid, metaphosphoric acid, organic phosphoric acid and their ammonium salts; the fluorine containing compound is a fluoric acid compound comprising at least one of Zr, Ti, Si and Ha, wherein the fluoric acid compound comprises 6 fluorine atoms; the silicon containing compound consists of a silane coupling agent and a silica sol having a particle diameter of less than 100 nm, wherein the silane coupling agent is selected from at least one of vinyl silane coupling agent, amino silane coupling agent, epoxy silane coupling agent and acryloxy silane coupling agent;

and the surfactant is selected from at least one of carboxylate salt, sulfuric acid ester salt, sulfonate salt, and phosphoric acid ester salt.

The single-face electrogalvanized surface treated steel plate of the invention is developed according to the processing and service characteristics of the material for fuel tanks, wherein the treated face of the plated surface of the steel plate is used as the inner side of the fuel tank and thus contacts the fuel and its degradation liquid; while the non-plated surface needs coating treatment with paint before used nakedly. With respect to welding properties, a single-face plated product has better weldability than a double-face plated product in an appropriate welding process. The coating layer resulting from surface treatment is an inorganic system and has a thickness of no more than 0.5 μm. The coating layer resulting from surface treatment has good electrical conductivity, has no influence on welding properties in spot welding, seam welding and argon arch welding, and does not produce abnormal volatiles.

The invention further provides a process of making a single-face electrogalvanized, chromium free surface treated steel plate used for fuel tanks and having superior gasoline degradation liquid resistance, good salt fog corrosion resistance and good processability, wherein the single-face electrogalvanized surface treated steel plate, which meets the requirements on processing and use of material for fuel tanks, is obtained by single-pass roll coating and low-temperature solidification.

A process of making a single-face electrogalvanized, chromium free surface treated steel plate used for fuel tanks, said process comprises steps of single-pass roll coating, low-temperature solidification and medium oil finishing. According to the process, the plated surface of the electrogalvanized steel plate is coated with the above stated inorganic aqueous surface treatment agent, then solidified at a low temperature of 70-100° C., and finally oil finished on the surface at an oiling amount of 1.0-1.9 g/m$^2$ to obtain the single-face electrogalvanized, chromium free surface treated steel plate in which the weight of the plated layer is 10-110 g/m$^2$, and the weight of the skin film resulting from surface treatment is 100-600 mg/m$^2$.

A typical process chart for processing the material for a fuel tank is shown in FIG. 1, wherein processability, corrosion resistance and gasoline degradation liquid resistance in service are special characteristics of this product. Gasoline degradation liquid corrosion is the most important form of corrosion in the service of a fuel tank. In the service, the surface of the steel plate has to not only have superior resistance to gasoline degradation liquid, but also ensure that the failure mode of the surface should not affect the safe use of the fuel tank. For example, flake or floc leachate resulting from failure of the skin film on the surface will lead to safety problems such as oil passage clogging, engine malfunction, etc.

After extensive experimental study, the above inorganic aqueous surface treatment agent and the single-face electrogalvanized, chromium free surface treated steel plate obtained by using this surface treatment agent are finally obtained according to the invention. The inventors have discovered in research that an electrogalvanized surface treated steel plate, which has superior gasoline degradation liquid resistance, good salt fog corrosion resistance, good processability and meets the requirements of a fuel tank for processing and use, may be formed in a high speed continuous production process by treating the surface of a steel plate having a zinc based plated layer with a surface treatment agent comprising particular metallic ion compound, vanadium containing compound, phosphorus containing compound, fluoric acid containing compound and particular silane coupling agent, silica sol and like components in a manner of single-pass roll coating and low-temperature solidification. No flake or floc leachate will be formed by the failure of the skin film on the surface of the steel plate.

According to the invention, the single-face electrogalvanized surface treated steel plate having superior gasoline degradation liquid resistance, good salt fog corrosion resistance and good processability for special use for fuel tanks may be manufactured with a simple process which may be fulfilled by one coating and one baking procedure, i.e. single-pass roll coating, low-temperature solidification and medium oil finishing. According to the invention, a cold rolled substrate meeting the requirements of a product for mechanical properties and size standard is firstly subjected to single-face electrogalvanizing treatment in an electrogalvanizing process, wherein the weight of the plated layer is 10-110 g/m$^2$; then the surface of the plated layer of the single-face electrogalvanized steel plate is coated with a surface treatment agent, wherein a vertical or horizontal roll coating device may be used in this surface coating process stage, and the coating amount of the surface treatment agent is controlled; after coating, the steel plate is transferred to a solidification process stage, wherein a hot air solidification device, an infrared heating solidification device, an induction heating solidification device and the like may be used for the solidification, and the surface temperature of the strip steel (PMT) is controlled at 70-100° C. during the solidification; the coated steel plate is air cooled and subjected to an oil finishing treatment at an oiling amount of 1.0-1.9 g/m$^2$, after which the product is supplied in the form of steel coil.

When the single-face electrogalvanized surface treated steel plate used for fuel tanks and having superior gasoline degradation liquid resistance and good processability is manufactured according to the invention, it is necessary to conduct the coating step only at the surface of the plated layer. If the non-plated surface is coated at the same time, the coatability of the surface will be affected. The above inorganic protective film resulting from surface treatment which covers the surface of the plated layer is a monolayer structure and has a film weight of 100-600 mg/m$^2$, preferably 250-450 mg/m$^2$. If the film weight is less than 100 mg/m$^2$, the salt fog corrosion resistance and the gasoline degradation liquid corrosion resistance will be decreased significantly. If the film weight is larger than 600 mg/m$^2$, the adhesion of the coating to the surface will be insufficient, such that exfoliation of the coating tends to occur during shaping and processing.

When the single-face electrogalvanized surface treated steel plate used for fuel tanks and having superior gasoline degradation liquid resistance and good processability is manufactured according to the invention, the suitable surface temperature of the strip steel (PMT) during solidification and drying is in the range of 70-100° C.; preferably, the temperature is controlled at 70-90° C. When the temperature is lower than 70° C., the reaction for the skin film tends to be insufficient, and thus the comprehensive resistance properties will be decreased. If the temperature is higher than 100° C., it has no positive effect in promoting the comprehensive resistance properties of the skin film, and energy consumption will be increased.

According to the invention, the single-face electrogalvanized surface treated steel plate used for fuel tanks and having superior gasoline degradation liquid resistance and good processability must be oil finished before coiling;

otherwise, the non-plated surface is susceptible to rusting during storage and transportation.

As compared with the prior art, the invention has the following beneficial effects:

For the single-face electrogalvanized, chromium free surface treated steel plate used for fuel tanks according to the invention, the skin film resulting from surface treatment has such comprehensive properties as superior gasoline degradation liquid resistance, good salt fog corrosion resistance, good processability, good weldability, alkali cleansing resistance, humidity-heat resistance, coating adhesion, etc. at the same time, and it is chromium free and environmentally friendly. The manufacturing process employs single-pass roll coating and low-temperature solidification, having the features of simplicity and low energy consumption. Particularly, the steel plate has excellent performance in respect of gasoline degradation liquid corrosion resistance in the environment wherein a fuel tank is used, and is suitable for processing and use of an automobile fuel tank shell, a motorcycle fuel tank shell and a general fuel tank shell.

DETAILED DESCRIPTION OF THE INVENTION

Figure 1:
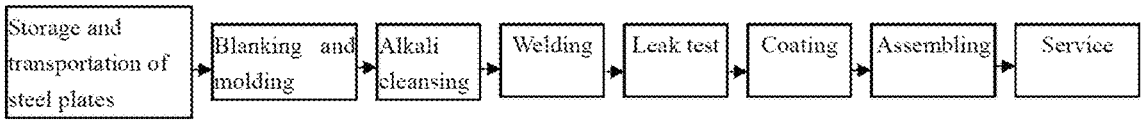
FIG. 1 is a typical process chart of processing a material for a fuel tank.

The technical solution of the invention will be further described in detail with reference to the following specific Examples.

The following Examples 1-7 and Comparative Examples 1-5 describe specifically the single-face electrogalvanized steel plate material used and the method of cleaning its surface; the inorganic aqueous surface treatment agents for the single-face electrogalvanized, chromium free surface treated steel plate (shown in Table 1); the method of treating the single-face electrogalvanized, chromium free surface treated steel plates; and the property evaluation of the resulting single-face electrogalvanized, chromium free surface treated steel plates (shown in Table 3).

1. Sample Plate for Test

Single-face electrogalvanized steel plate having a thickness of 0.8 mm and a zinc layer weight of 30/0 g/m$^2$.

2. Method of Cleaning the Single-Face Electrogalvanized Steel Plate:

The surface of the single-face electrogalvanized steel plate was spray cleaned with a degreaser having medium basicity (pH=11-12) to remove the smudge and oil adhered to the surface; then rinsed with pure water to remove the residual alkaline components from the surface; and dried by purging with cool air for later use.

3. The Compositions of the Surface Treatment Agents for Examples 1-7 and Comparative Examples 1-5 are Shown in Table 1.

TABLE 1

The compositions of the surface treatment agents for the Examples and Comparative Examples

| | Metallic ion compound (A), based on metallic element content "mol/L" | | Vanadium compound (B), based on V element content "mol/L" | | Phosphoric acid-type compound (C), based on P element content "mol/L" | | Fluoric acid-type compound (D), based on F element content "mol/L" | |
|---|---|---|---|---|---|---|---|---|
| No. | Type | Content | Type | Content | Type | Content | Type | Content |
| Example 1 | Zinc dihydrogen phosphate | 0.07 | Ammonium metavanadate | 0.01 | Phosphoric acid | 0.12 | Ammonium fluorotitanate | 0.06 |
| Example 2 | Manganese dihydrogen phosphate | 0.09 | Vanadyl oxalate | 0.01 | Phosphoric acid | 0.12 | Ammonium fluorozirconate | 0.06 |
| Example 3 | Magnesium dihydrogen phosphate | 0.09 | Vanadyl oxalate | 0.006 | Organic phosphoricacid | 0.1 | Ammonium fluorotitanate | 0.1 |
| Example 4 | Manganese dihydrogen phosphate | 0.09 | Vanadyl sulfate | 0.01 | Phosphoric acid | 0.03 | Ammonium fluorotitanate | 0.06 |
| Example 5 | Manganese dihydrogen phosphate | 0.2 | Vanadyl oxalate | 0.01 | Phosphoric acid | 0.12 | Ammonium fluorotitanate | 0.06 |
| Example 6 | Manganese dihydrogen phosphate | 0.09 | Vanadyl oxalate | 0.02 | Phosphoric acid | 0.12 | Ammonium fluorotitanate | 0.06 |
| Example 7 | Manganese dihydrogen phosphate | 0.09 | Vanadyl oxalate | 0.01 | Phosphoric acid | 0.35 | Ammonium fluorotitanate | 0.08 |
| Example 8 | Manganese dihydrogen phosphate | 0.09 | Vanadyl oxalate | 0.01 | Phosphoric acid | 0.12 | Ammonium fluorotitanate | 0.04 |
| Comp. Ex. 1 | Manganese dihydrogen phosphate | 0.4 | Vanadyl oxalate | 0.01 | Phosphoric acid | 0.12 | Ammonium fluorotitanate | 0.06 |
| Comp. Ex. 2 | — | — | Vanadyl sulfate | 0.01 | Phosphoric acid | 0.12 | Ammonium fluorotitanate | 0.06 |
| Comp. Ex. 3 | Manganese dihydrogen phosphate | 0.09 | Vanadyl oxalate | 0.01 | Phosphoric acid | 0.16 | — | — |

TABLE 1-continued

The compositions of the surface treatment agents for the Examples and Comparative Examples

| | | | | | | | | |
|---|---|---|---|---|---|---|---|---|
| Comp. Ex. 4 | Zinc dihydrogen phosphate | 0.09 | Vanadyl oxalate | 0.01 | Phosphoric acid | 0.12 | Ammonium fluorozirconate | 0.06 |
| Comp. Ex. 5 | Manganese dihydrogen phosphate | 0.07 | Vanadyl oxalate | 0.01 | Phosphoric acid | 0.12 | Ammonium fluorotitanate | 0.06 |
| Comp. Ex. 6 | Manganese dihydrogen phosphate | 0.09 | Vanadyl oxalate | 0.01 | Phosphoric acid | 0.12 | Ammonium fluorozirconate | 0.06 |

| | Silane coupling agent (E), based on Si element content "mol/L" | | Silica sol (F), based on Si element content "mol/L" | | Surfactant (G), "mol/L" | | PMT |
|---|---|---|---|---|---|---|---|
| No. | Type | Content | Type | Content | Type | Content | ° C. |
| Example 1 | Silane coupling agent | 0.16 | Silica sol (20 nm) | 0.07 | Sulfonic acid ester salt | 0.0005 | 85 |
| Example 2 | Silane coupling agent | 0.16 | Silica sol (20 nm) | 0.07 | Sulfuric acid ester salt | 0.0005 | 75 |
| Example 3 | Silane coupling agent | 0.16 | Silica sol (40 nm) | 0.07 | Sulfonic acid ester salt | 0.0007 | 85 |
| Example 4 | Silane coupling agent | 0.16 | Silica sol (40 nm) | 0.07 | Sulfuric acid ester salt | 0.0007 | 75 |
| Example 5 | Silane coupling agent | 0.16 | Silica sol (20 nm) | 0.05 | Sulfuric acid ester salt | 0.0007 | 85 |
| Example 6 | Silane coupling agent | 0.16 | Silica sol (60 nm) | 0.07 | Sulfonic acid ester salt | 0.0007 | 85 |
| Example 7 | Silane coupling agent | 0.1 | Silica sol (20 nm) | 0.03 | Sulfuric acid ester salt | 0.0007 | 90 |
| Example 8 | Silane coupling agent | 0.3 | Silica sol (20 nm) | 0.1 | Sulfuric acid ester salt | 0.0015 | 85 |
| Comp. Ex. 1 | Silane coupling agent | 0.16 | Silica sol (20 nm) | 0.07 | Sulfuric acid ester salt | 0.0005 | 85 |
| Comp. Ex. 2 | Silane coupling agent | 0.16 | Silica sol (20 nm) | 0.07 | Sulfuric acid ester salt | 0.0005 | 85 |
| Comp. Ex. 3 | Silane coupling agent | 0.16 | Silica sol (20 nm) | 0.07 | Sulfuric acid ester salt | 0.0007 | 75 |
| Comp. Ex. 4 | Silane coupling agent | 0.05 | Silica sol (40 nm) | 0.07 | Sulfonic acid ester salt | 0.0007 | 85 |
| Comp. Ex. 5 | Silane coupling agent | 0.16 | Silica sol (20 nm) | 0.07 | Sulfuric acid ester salt | 0.0005 | 140 |
| Comp. Ex. 6 | Silane coupling agent | 0.55 | Silica sol (20 nm) | 0.07 | Sulfuric acid ester salt | 0.0007 | 85 |

Note:

1. In "Phosphoric acid-type compound (C)", the organic phosphoric acid in Example 3 is 1-hydroxyethylidene-1,1- diphosphonic acid (HEDP);
2. In "Silane coupling agent (E)", vinyl silane coupling agent is used in Examples 3, 4, and the silane coupling agent for the rest is a mixture of amino silane coupling agent and epoxy silane coupling agent mixed at a ratio of 1:2;
3. In "Surfactant (G)", the "surfactant (G)" used in Examples 1, 3, 7 and Comparative Example 4 is sodium dodecyl sulfonate, and the surfactant for the rest is sodium dodecyl sulfate.

4. Method of Treating the Single-Face Eletrogalvanized, Chromium Free Steel Plates with the Inorganic Aqueous Surface Treatment Agents:

The surface treatment agents of the Examples and Comparative Examples listed in Table 1 were used to coat the plated surface of the single-face electrogalvanized steel plates respectively. A roll coating process was used for coating. In the roll coating process, the following procedure was used to control the coating thickness: the surface of the coating roll was wrapped with polyurethane resin; reverse coating was used in the coating process, i.e. the coating process was conducted in such a manner where the surface of the coating roll and the strip steel moved in contrary directions; in the coating process, the ratio between the rotation rate of the coating roll and that of the strip steel was 0.5-1.5, and the ratio between the rotation speed of the pick-up roll and that of the strip steel was 0.5-1.5; the pressure of the pick-up roll and the coating roll was 50-240 kg; then, solidification was conducted at 70-100° C. (see Table 1 for the specific solidifying temperatures), so that single-face eletrogalvanized, chromium free surface treated steel plates were obtained wherein the amount of the skin film resulting from surface treatment was 250-450 mg/m$^2$ (see Table 2).

TABLE 2

| | Amount of skin film (g/m$^2$) |
|---|---|
| Example 1 | 0.4 |
| Example 2 | 0.3 |
| Example 3 | 0.4 |
| Example 4 | 0.4 |
| Example 5 | 0.4 |
| Example 6 | 0.4 |
| Example 7 | 0.3 |
| Example 8 | 0.5 |
| Comp. Ex. 1 | 0.4 |
| Comp. Ex. 2 | 0.4 |
| Comp. Ex. 3 | 0.4 |
| Comp. Ex. 4 | 0.4 |

TABLE 2-continued

| | Amount of skin film ($g/m^2$) |
|---|---|
| Comp. Ex. 5 | 0.4 |
| Comp. Ex. 6 | 0.4 |

5. Property Assessment

Figure 3:
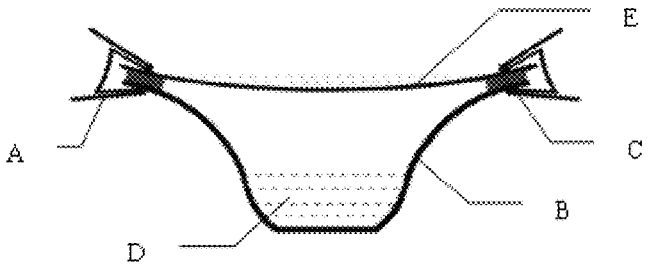
FIG. 3 is a schematic view showing a degraded gasoline soaking test, wherein A. seal clip; B. test sample; C. seal gasket; D. degraded gasoline; E. seal glass.

The properties of the single-face electrogalvanized surface treated steel plate samples obtained in the above Examples and Comparative Examples were assessed using the following experimental methods, and the results are shown in FIG. 3.

(1) Gasoline Degradation Liquid Resistance

Figure 2:
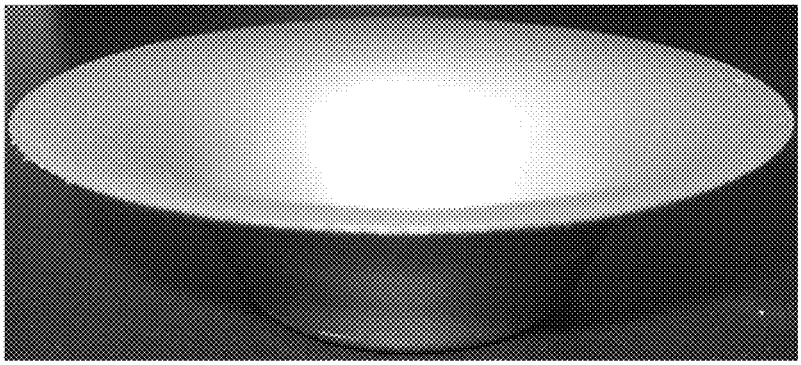
FIG. 2 is a picture of a test sample after impact molding.

The acidic product produced by the degradation of gasoline during storage and use concentrates in condensed water coexisting with gasoline, and forms a highly corrosive medium having relatively high acidity which corrodes fuel tanks. A simulated gasoline degradation liquid was used as a corrosive medium in this test, and the soaking test was conducted to assess corrosion resistance. With such factors as machining deformation, cleansing, coating (baking) of a typical fuel tank taken into account, the following test procedure was developed:

Assessment of corrosion resistance of a steel plate for fuel tank in the condition of ultimate service: first, an impact molded part (shown in FIG. 2) was spray cleaned with a degreaser having medium basicity (pH=11-12) to remove the smudge and oil adhered to the surface thereof; then the part was rinsed with pure water to remove the residual alkaline components on the surface and dried by purging with cool air; subsequently, the sample was placed in an oven, baked at 18° C. for 20 minutes, and air cooled to room temperature; then, 20 ml gasoline degradation liquid and 5 ml gasoline were infused into the "cup", the assembly was sealed (shown in FIG. 3) and placed in an environment at a constant temperature of 40° C.

120 h later, the rusting level of the "cup" bottom was observed:

◎: The area ratio of white rust was less than 1%;

○: The area ratio of white rust was more than 1% and less than 10%;

Δ: The area ratio of white rust was more than 10% and less than 50%;

x: The area ratio of white rust was more than 50% and red rust appeared.

(2) Salt Fog Corrosion Resistance

The samples were machined into 150 mm×75 mm sample plates, and the edges thereof were sealed. The fixed-time salt fog resistance test was conducted with reference to ASTMB 117.

◎: The area of white rust was less than 3%;

○: The area of white rust was 3%-10%;

Δ: The area of white rust was more than 30%;

x: The area of white rust was more than 90%, or red rust appeared.

(3) Adhesion Property of the Coatings

The samples were machined into 150 mm×75 mm sample plates without forming any scratches on the surfaces thereof. An Erichsen tester was used to test the sample plates until the Erichsenvalue was 7 mm; then 3M Scotch tape was used for peeling; and the state of the surface coating was observed.

◎: No change in appearance;

○: The surface whitened slightly;

Δ: The surface whitened apparently, and the coating peeled off slightly;

x: The coating peeled off in large scale.

(4) Weldability

Galvanized plates having identical steel plate thickness and plated layer thickness were used as substrates for surface treatment with the same process, and the weldability of the material was characterized by test results of spot welding and seam welding in a range of weldable electrical current.

◎: The appearance at the welding position was good, and the performance was superior;

○: The appearance at the welding position was good, and the performance basically satisfied the requirements;

Δ: The performance at the welding position was poor;

x: Not weldable.

(5) Alkali Resistance

Flat plate samples were spray cleaned in a degreasing agent having medium basicity (pH=11-12) at 50° C. for 3 minutes to remove the smudge and oil adhered to the surface; then rinsed with pure water to remove the residual alkaline components on the surface and dried by purging with cool air; and the state of the surface coatings was observed.

◎: No change in appearance;

○: The appearance whitened slightly;

Δ: The appearance whitened and a portion of the skin film dissolved or peeled off;

x: The skin film dissolved or peeled off completely.

(6) Humidity-Heat Resistance

A stack of laminated flat plate samples was clamped tightly with a clip and placed in a humid heat box at a temperature of 48° C. and a relative humidity of 98% for 120 hours; and the change of the appearance was observed.

◎: No change in appearance;

○: The appearance blackened slightly;

Δ: The appearance blackened and local white rust appeared;

x: Large area rusting appeared.

As seen from the assessment results of the performances of the various Examples and Comparative Examples (shown in FIG. 3), the single-face electrogalvanized surface treated steel plates of Examples 1-8 exhibited good comprehensive performances in terms of the various assessment items. Particularly, the single-face electrogalvanized surface treated steel plates of Examples 1, 2, 3 and 5 showed excellent comprehensive performances. In Example 4, the reduction of the relative addition amount of component C in the surface treatment agent affected the protective function of the phosphate reactant on the surface, leading to decreased salt fog corrosion resistance of the skin film resulting from surface treatment. In Example 6, the particle diameter of component F in the surface treatment agent was relatively large, and had some influence on the gasoline degradation liquid resistance of the skin film. Excessive addition of component A in the surface treatment agent of Comparative Example 1 resulted in incomplete reaction of component A during film formation and its physical deposit which affected the alkali resistance, humidity-heat resistance of the surface and the adhesion of the coating. The absence of component A in the surface treatment agent of Comparative Example 2 rendered poor resistance of the skin film structure to acidic medium corrosion, i.e. poor gasoline degradation liquid resistance, and insufficient wear resistance of the skin film. The absence of component D in the surface treatment agent of Comparative Example 3 affected the alkali cleansing resistance of the skin film. The amount of component E in the surface treatment agent of Comparative Example 4 was so low that the salt fog corrosion resistance of the skin film decreased remarkably. The amount of component E in the surface treatment agent of Comparative Example 6 was rather high, such that the condensate of the silane coupling agent was the main component in the surface skin film structure. This skin film structure possessed excellent salt fog corrosion resistance, but the gasoline degradation liquid resistance was lowered obviously. Low-temperature solidification at 75° C. was employed in Example 2, and high-temperature solidification at 140° C. was adopted in Comparative Example 5. These two ways of solidification provided skin films resulting from surface treatment which showed superior comprehensive performances, indicating that solidification via film forming reaction may be completed with these surface treatment agents at relatively low temperatures (PMT=70-100° C.). Unduly high temperature not only increases energy consumption, but also barely contributes to the improvement of the comprehensive resistance of the skin film resulting from surface treatment.

TABLE 3

Performances of Various Examples and Comparative Examples

| No. | Gasoline degradation liquid corrosion resistance | Salt fog corrosion resistance | Weldability | Alkali cleansing resistance | Humidity-heat resistance | Coating adhesion |
|---|---|---|---|---|---|---|
| Example 1 | ◎ | ◎ | ◎ | ◎ | ◎ | ◎ |
| Example 2 | ◎ | ◎ | ◎ | ◎ | ◎ | ◎ |
| Example 3 | ◎ | ◎ | ◎ | ◎ | ◎ | ◎ |
| Example 4 | ○ | ○ | ◎ | ○ | ◎ | ◎ |
| Example 5 | ◎ | ◎ | ◎ | ◎ | ◎ | ◎ |
| Example 6 | ○ | ◎ | ◎ | ◎ | ◎ | ◎ |
| Example 7 | ◎ | ○ | ◎ | ◎ | ◎ | ◎ |
| Example 8 | ○ | ◎ | ○ | ◎ | ◎ | ◎ |
| Comp. Ex. 1 | ○ | ◎ | ○ | ○ | Δ | X |
| Comp. Ex. 2 | X | ○ | ◎ | ◎ | ◎ | ◎ |
| Comp. Ex. 3 | ◎ | Δ | ◎ | X | ○ | ◎ |
| Comp. Ex. 4 | ◎ | X | ◎ | ○ | ◎ | Δ |
| Comp. Ex. 5 | ◎ | ◎ | ◎ | ◎ | ◎ | ◎ |
| Comp. Ex. 6 | X | ◎ | ○ | ◎ | ◎ | ◎ |

We claim:

1. A chromium free aqueous surface treatment agent for the surface treatment of a single-face electrogalvanized steel plate, formulated by dissolving or dispersing each component in an aqueous medium, wherein the aqueous solution comprises the following components:

(A) one or more metallic ion compounds comprising at least one of the ions of $Zn^{2+}$, $Mn^{2+}$, $Mg^{2+}$, $Ni^{2+}$, $Al^{3+}$ and $Ca^{2+}$, wherein the molar concentration of the metallic ion in the surface treatment agent is 0.01-0.3 mol/L;

(B) one or more vanadium compounds selected from the group consisting of a compound comprising $V^{4+}$, a compound comprising $V^{5+}$ and a combination thereof, wherein the molar concentration of V element in the surface treatment agent is 0.005-0.08 mol/L;

(C) one or more compounds comprising at least one of phosphoric acid, pyrophosphoric acid, metaphosphoric acid, organic phosphonic acid compound or organic phosphoric acid compound and the ammonium salts thereof, wherein P element of (C) has a molar concentration of 0.05-1 mol/L in the surface treatment agent;

(D) one or more hexafluoric acid compounds comprising at least one of Zr, Ti, Si and Hf, wherein the hexafluoric acid compound comprises 6 fluorine atoms, and F element in (D) has a molar concentration in the surface treatment agent of 0.01-0.2 mol/L;

(E) one or more silane coupling agents comprising at least one of vinyl silane coupling agent, amino silane coupling agent, epoxy silane coupling agent and acryloxy silane coupling agent, wherein the molar concentration of the silane coupling agent in the surface treatment agent is 0.1-0.5 mol/L;

(F) a silica sol comprising particles having a particle diameter less than 100 nm, wherein the molar concentration of its Si element in the surface treatment agent is 0.01-0.2 mol/L; and (G) one or more surfactant comprising at least one of carboxylate, sulfuric acid ester salt, sulfonate and phosphoric acid ester salt, wherein the molar concentration of the surfactant in the surface treatment agent is 0.0001-0.003 mol/L;

wherein the total solid content in the aqueous surface treatment agent is 2 wt %-20 wt % of the surface treatment agent.

2. The chromium free aqueous surface treatment agent for the surface treatment of a single-face electrogalvanized steel plate according to claim 1, wherein the molar concentration of the metallic ions in the surface treatment agent is 0.07-0.2 mol/L; the molar concentration of V element in the surface treatment agent is 0.005-0.03 mol/L; P element of (C) has a molar concentration of 0.08-0.4 mol/L in the surface treatment agent; F element in (D) has a molar concentration in the surface treatment agent of 0.04-0.1 mol/L; the molar concentration of the silane coupling agent in the surface treatment agent is 0.1-0.4 mol/L; the molar concentration of Si element in the surface treatment agent is 0.06-0.12 mol/L; the molar concentration of the surfactant in the surface treatment agent is 0.0005-0.0015 mol/L; and the total solid content in the aqueous surface treatment agent is 4 wt %-15 wt % of the surface treatment agent.

3. The chromium free aqueous surface treatment agent for the surface treatment of a single-face electrogalvanized steel plate according to claim 1, wherein the metallic ion compound is dihydrogen phosphate, hydrogen phosphate or phosphate of the metallic ion.

4. The chromium free aqueous surface treatment agent for the surface treatment of a single-face electrogalvanized steel plate according to claim 1, wherein the vanadium containing compound is selected from at least one of vanadium pentoxide, vanadium tetroxide, sodium metavanadate, ammonium metavanadate, sodium pyrovanadate, vanadyl sulfate and vanadyl oxalate.

5. The chromium free aqueous surface treatment agent for the surface treatment of a single-face electrogalvanized steel plate according to claim 1, wherein the organic phosphonic acid compound or organic phosphoric acid compound is selected from at least one of nitrilotris(methylene phosphonic acid), 1-hydroxyethylidene-1,1-diphosphonic acid and sodium ethylenediamine tetramethylene phosphate.

6. The chromium free aqueous surface treatment agent for the surface treatment of a single-face electrogalvanized steel plate according to claim 1, wherein the hexafluoric acid compound comprising Ti is selected from ammonium fluorotitanate; and the hexafluoric acid compound comprising Zr is selected from ammonium fluorozirconate.

7. The chromium free aqueous surface treatment agent for the surface treatment of a single-face electrogalvanized steel plate according to claim 1, wherein the surfactant is selected from at least one of fluorinated carboxylic acid, sodium fatty alcohol polyoxyethylene ether carboxylate, ternary polycarboxylic acid, sodium dodecyl sulfate and sodium dodecyl sulfonate.

8. A method of treating a surface of a single-face electrogalvanized steel plate used for fuel tanks, comprising: coating a plated surface of a single-face electrogalvanized steel plate with the chromium free aqueous surface treatment agent of claim 1, and then solidifying at 70-100° C. to obtain the single-face electrogalvanized steel plate having a skin film of 100-600 mg/m$^2$ resulting from the surface treatment.

9. A single-face electrogalvanized steel plate used for fuel tanks with the single-face plated surface of the steel plate being coated with a chromium free skin film resulting from surface treatment, wherein the chromium free skin film resulting from surface treatment comprises the following components:

one or more metallic ion compounds comprising at least one of the ions of $Zn^{2+}$, $Mn^{2+}$, $Mg^{2+}$, $Ni^{2+}$, $Al^{3+}$ and $Ca^{2+}$, and the metallic ion compound comprises 1%-10% of the skin film resulting from surface treatment based on metallic elements;

one or more vanadium-containing compounds selected from the group consisting of a compound comprising $V^{4+}$, a compound comprising $V^{5+}$, and a combination thereof, and the vanadium-containing compound comprises 0.1%-5% by weight of the skin film resulting from surface treatment based on vanadium element;

one or more phosphorus containing compounds, which comprise 1%-10% by weight of the skin film resulting from surface treatment based on phosphorus element;

one or more fluorine containing compounds, which comprise 1%-10% by weight of the skin film resulting from surface treatment based on fluorine element;

one or more silicon containing compounds, which comprise 1%-10% by weight of the skin film resulting from surface treatment based on silicon element;

one or more surfactants, which comprise 0.1%-1% by weight of the skin film resulting from surface treatment;

wherein the skin film resulting from the surface treatment covering the plated layer surface of the single-face electrogalvanized steel plate is a monolayer structure and has a film weight of 100-600 mg/m$^2$.

10. The single-face electrogalvanized steel plate used for fuel tanks according to claim 9, wherein the metallic ion compound is dihydrogen phosphate, hydrogen phosphate or phosphate of the metallic ion; the vanadium containing compound is selected from a group consisting of a compound comprising $V^{4+}$, a compound comprising $V^{5+}$ and a combination thereof; the phosphorus containing compound is selected from at least one of phosphoric acid, pyrophosphoric acid, metaphosphoric acid, organic phosphoric acid and the ammonium salts thereof; the fluorine containing compound is a fluoric acid compound comprising at least one of Zr, Ti, Si and Hf, wherein the fluoric acid compound comprises 6 fluorine atoms; the silicon containing compound consists of a silane coupling agent and a silica sol comprising particles having a particle diameter of less than 100 nm, wherein the silane coupling agent is selected from at least one of vinyl silane coupling agent, amino silane coupling agent, epoxy silane coupling agent and acryloxy silane coupling agent; and the surfactant is selected from at least one of carboxylate salt, sulfuric acid ester salt, sulfonate salt, and phosphoric acid ester salt.

11. A process of making a single-face electrogalvanized steel plate used for fuel tanks, wherein the steel plate has been subjected to surface treatment, comprising the steps of single-pass roll coating, low-temperature solidification and medium oil finishing, wherein a plated surface of the single-face electrogalvanized steel plate is coated with the chromium free aqueous surface treatment agent of claim 1, then solidified at a low temperature of 70-100° C. to form a skin film, and finally oil finished on the surface at an oiling amount of 1.0-1.9 g/m$^2$ to obtain the single-face electrogalvanized, steel plate for fuel tanks which has the skin film with an amount of 100-600 mg/m$^2$.

12. The process of making a single-face electrogalvanized, steel plate used for fuel tanks according to claim 11, wherein the weight of the skin film resulting from the surface treatment of the single-face electrogalvanized, steel plate is 250-450 mg/m$^2$.

* * * * *